United States Patent [19]

Tachino

[11] 4,142,609

[45] Mar. 6, 1979

[54] ELEVATOR CONTROL SYSTEM

[75] Inventor: Kenzo Tachino, Inazawa, Japan

[73] Assignee: Mitsubishi Denki Kabushiki Kaisha, Tokyo, Japan

[21] Appl. No.: 860,195

[22] Filed: Dec. 13, 1977

[30] Foreign Application Priority Data

Dec. 13, 1976 [JP] Japan ..... 51-149512

[51] Int. Cl.[2] ..... B66B 3/02

[52] U.S. Cl. ..... 187/29 R

[58] Field of Search ..... 187/29

[56] References Cited

U.S. PATENT DOCUMENTS

| | | | |
|---|---|---|---|
| 3,370,676 | 2/1968 | McDonald et al. | 187/29 |
| 3,590,355 | 6/1971 | Davis et al. | 187/29 |
| 3,779,346 | 12/1973 | Winkler | 187/29 |
| 3,783,974 | 1/1974 | Gilbert et al. | 187/29 |
| 4,009,766 | 3/1977 | Satoh | 187/29 |

*Primary Examiner*—Robert K. Schaefer
*Assistant Examiner*—W. E. Duncanson, Jr.
*Attorney, Agent, or Firm*—Oblon, Fisher, Spivak, McClelland & Maier

[57] ABSTRACT

An elevator control system for an elevator system of the type in which a digital position detector is used and it detects relatively an amount of the car travelling to control the elevator system, is provided. The elevator control system comprises; a first power source; a detector for detecting ceasing of the first power source function resulting from power stoppage or other power source trouble; a car position detector including a position signal storing circuit for electrically storing the car position signal representing the car position; a second power source for supplying power source to the car position detector to secure its normal operation till the car completely stops after the power source trouble; a third power source for supplying power source to only the position signal storing circuit includes in the car position detector after the second power source ceases its function. With such a construction, the final position at which the car stops due to its power source trouble is continuously stored with an accuracy and, after restoration of the power source from the trouble, the car may quickly initiate its normal operation.

4 Claims, 7 Drawing Figures

ELEVATOR CONTROL SYSTEM

BACKGROUND OF THE INVENTION

The present invention relates to an elevator position detector for an elevator system with a position detector for detecting digitally the position of a car and being controlled by its position detecting signal, in which a power source operable even in an abnormal condition such as power stoppage is provided and the correct position of the car is continuously stored and, when the power source is restored to a normal condition, it immediately initiates a normal operation of the elevator.

Generally, in an elevator control system, when abnormal condition of power source such as power stoppage takes place, it is placed in an emergency stoppage condition immediately to stop the car of elevator. Some amount of time is necessary till the car completely stops. Further, it is necessary to correctly detect and store the final position at which the car completely stops to perform an ordinary operation immediately after the power source is restored to its normal condition of operation. In the case of elevators installed in general office buildings, power is sometimes dropped for a relatively long time in the New Year or other consecutive holidays. Even in such a case, the elevator position detector must store the correct position of the car for a long period.

One of the conventional countermeasures for such the power trouble in the elevator control system is to use battery for the power source of the position detector to eliminate the power stoppage occurence. Another is to temporarily convert the electrical position signal to a mechanical position signal as of latching relays at the power stoppage and to store it and, when the power source returns to its normal operating condition, to reconvert the mechanical position signal to the original one. However, the former countermeasure is defective in that batteries with a large power capacity i.e. non-power stoppage power source, are necessary. The latter is defective in that the signal conversion mechanism is complex and the mechanical memory means is poor in space factor.

Recently, a rapid progress of digital integrated circuit technology produces a number of commercially available control circuits with a high integration density but low power consumption. Particularly, in the CMOS digital integrated circuits, its static current consumption of commercially available circuits is below 1 mA per package in the scale of MSI (medium scale integrated circuit).

SUMMARY OF THE INVENTION

Accordingly, the primary object of the present invention is to provide an elevator control system which is operable with a non-power stoppage power source of small capacity and small in size and power consumption.

Briefly, in the present invention, the car position is stored in a shift register circuit with low power consumption and high integration density and a large memory capacity per package. Power source trouble due to the power stoppage or the like of a first power source for an elevator control circuit, is detected. A second power source for position detector is provided to maintain the function of a position detector until the car completely stops and the position of the car is statically loaded into the shift register circuit. A third power source is included which is a non-power stoppage power source for supplying current only to one package of the shift register circuit after the second power source drops in its power. Further, a clock control circuit is included to control the supply of clock to the shift register circuit. The static loading and dynamic loading of the car position is switched securely to ensure storing of the car position even in the case of power source trouble such as power stoppage. After restoration of the power source from the trouble, the car may quickly restart its normal operation.

The invention will be better understood from the following description taken in connection with the accompanying drawings, in which.

BRIEF DESCRIPTION OF THE DRAWINGS

FIG. 4(*b*) shows timing diagrams for illustrating the operation which is enlarged in time scale of a part of the timing diagram of FIG. 4(*a*);

FIG. 5(*b*) shows a set of operational diagrams which is enlarged in time scale of a part of the timing diagrams of FIG. 5(*a*).

DESCRIPTION OF THE PREFERRED EMBODIMENTS

An preferred embodiment of an elevator control system according to the present invention will be given with reference to FIGS. 1, 2, 3, 4(*a* ) and (*b* 7 and 5(*a* ) and (*b* ).

Figure 1:
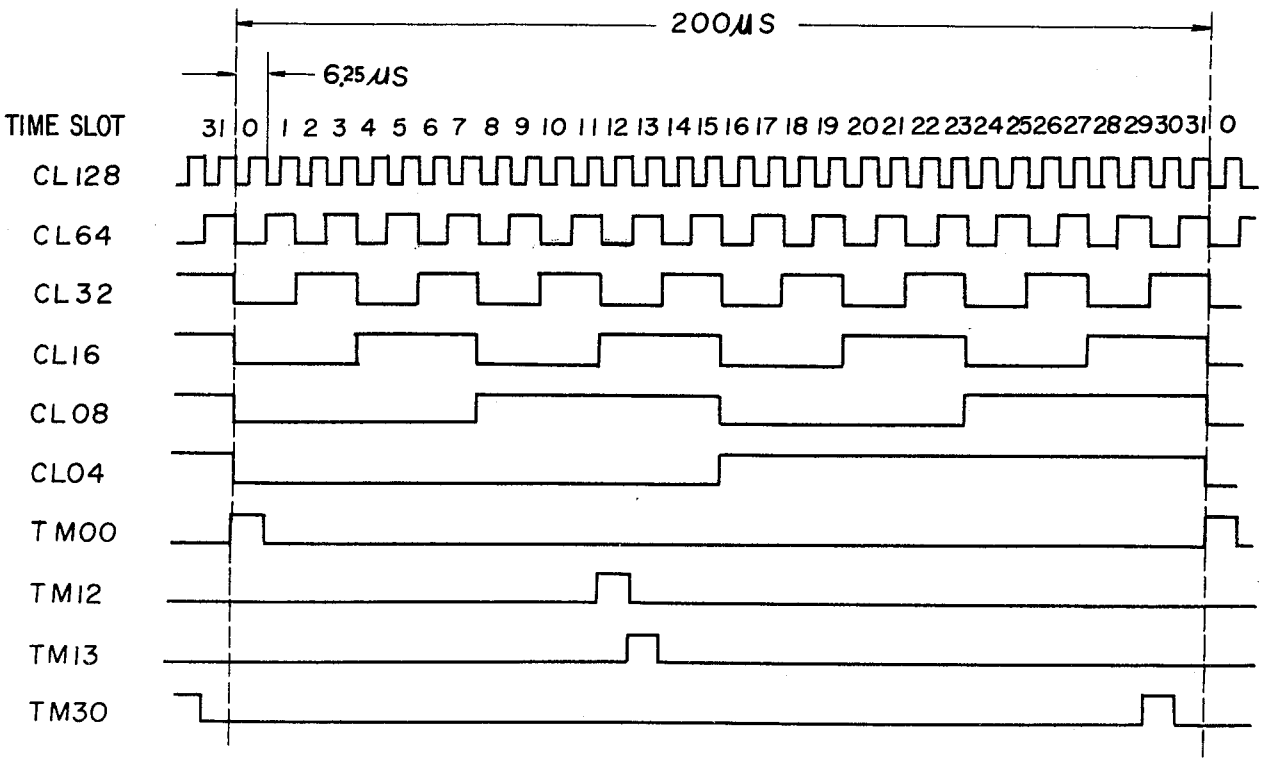
FIG. 1 shows a set of timing diagrams of a basic operation clock and timing signals during the period of the basic operation of an embodiment of an elevator control system according to the present invention.

FIG. 1 shows a set of timing diagrams of basic operation clocks, basic operation periods, and signals during one period thereof.

The operation period is 200 $\mu$ sec. and corresponds to 32 cycles of a 160 KHz operation basic clock CL 128. Clocks CL64, CL32, CL16, CL08 and CL04 are obtained by frequency-dividing the basic operation clock CL128 into 1/2, 1/4, 1/8, 1/16 and 1/32. One period of CL04 corresponds to the basic operation period.

Timing signals TM00, TM12, TM13, and TM30 have specific time positions in the basic operation period and these are formed under the following logic condition by using clocks CL64, CL32, CL16, CL08, and CL04.

$$TM00 = \overline{CL64}\cdot\overline{CL32}\cdot\overline{CL16}\cdot\overline{CL08}\cdot\overline{CL04}$$

$$TM12 = \overline{CL64}\cdot\overline{CL32}\cdot CL16\cdot CL08\cdot\overline{CL04}$$

$$TM13 = CL64\cdot\overline{CL32}\cdot CL16\cdot CL08\cdot\overline{CL04}$$

$$TM30 = \overline{CL64}\cdot CL32\cdot CL16\cdot CL08\cdot CL04$$

The basic operation period is comprised of 32 times slots each of 6.25 $\mu$ sec. The specific time positions during the basic operation period will be numbered 0 to 31 for easy of explanation. For example, the position of the signal level "1" of the timing signal TM00 is named a time slot 0 and the time position of the signal level "1" of the timing signal TM13 a time slot 13 .

Figure 2:
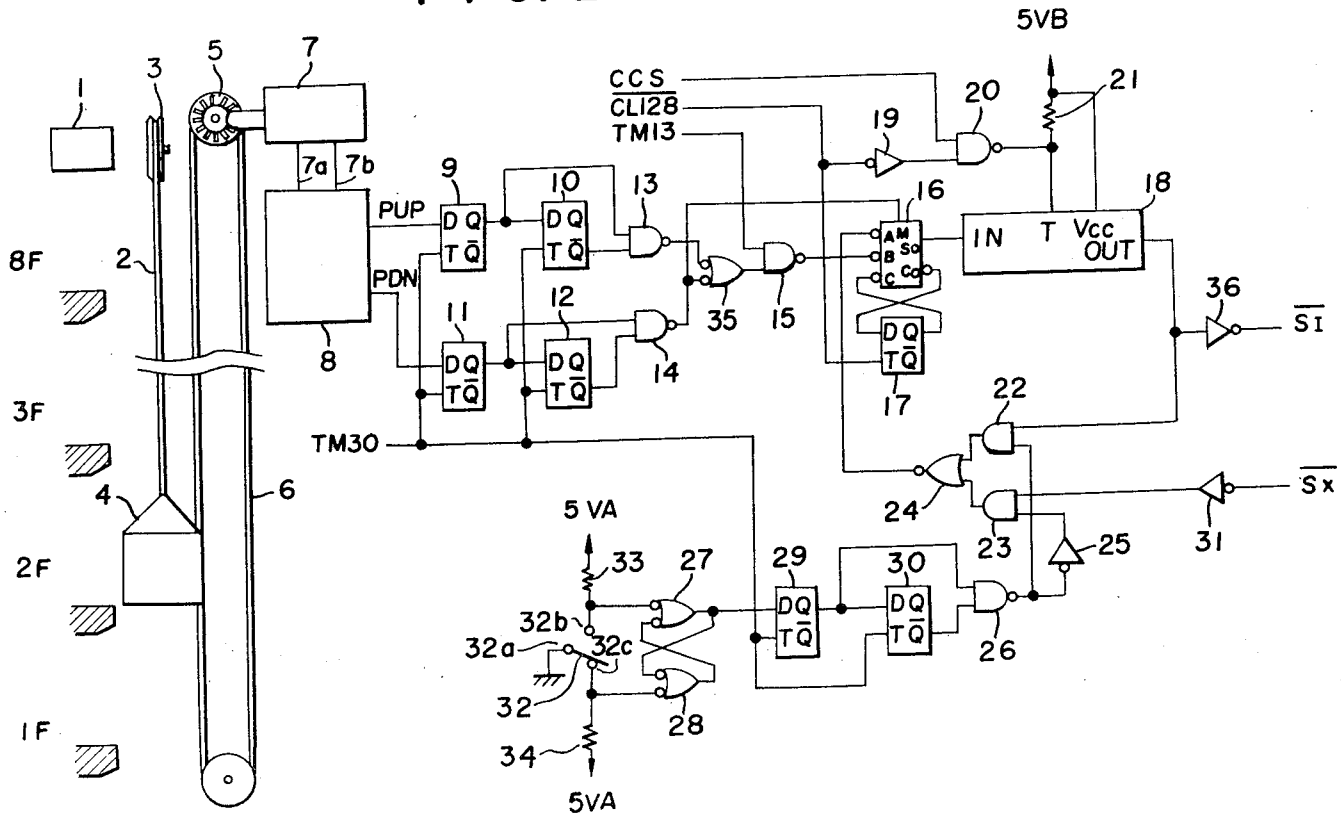
FIG. 2 shows a simple model of an elevator position detecting mechanism and a detailed circuit diagram of an elevator position detector in the embodiment.

Referring now to FIG. 2, there is shown a simple model of an elevator position detecting mechanism and a detailed circuit diagram of the elevator position detector. In the figure, (1) a traction machine, (2) a hoisting rope, (3) a traction sheave with the hoisting rope wound there around, (4) an elevator car (referred to as a car), (5) a governor, (6) a governor rope which is wound around the governor and coupled with an emergency stop means (not shown) installed at the car (4) and always moves at the same speed as of the car and, when the governor operates, transfers its action to the car (4) to stop the car (4), (7) a pulse generator which is driven by the governor to produce two-phase pulses *(7a)* and *(7b)* which are phased by 90°, and (8) a directional pulse generator which receives two kinds of pulses *(7a)* and *(7b)* generated by the pulse generator (7) to descriminate the moving direction of the car and produces an up-pulse signal in synchronism with the output pulses *(7a)* and *(7b)* of the pulse generator (7) when the car travels up, and down pulse signal PDN in synchronism with the pulses *(7a)* and *(7b)* when in down travelling. (9), (10), (11) and (12) designate edge trigger type flip-flops. The up-pulse signal PUP is converted into a pulse with the width corresponding to the length of one period of the timing pulse signal TM00 through the flip-flops (9),(10) and an NAND gate (13), and it passes through the gate (35) to enable a gate (15) to permit the timing signal TM13 to pass therethrough. Similarly, the down pulse signal PDN is converted into a pulse with the width corresponding to one period length of the timing signal TM00 through the flip-flops (11) and (12) and a gate (14) to pass through a gate (35) to enable the gate (15) to permit the timing signal TM13 to pass therethrough.

That is, each of the up-pulse PUP and the down-pulse PDN is converted into a single pulse in synchronism with the timing pulse TM13. (16) is an adder-subtractor with addition input A, addition-subtraction input B, a carry input C, a carry output $C_o$, an addition-subtraction selecting input M, and an operation output terminal $S_o$, and performs a subtraction when the addition-subtraction selecting input M is at "0" level and performs an addition when it is at "1"(18) designates a shift-register of series 32 bits construction which is constructed by an integrated circuit with low power consumption (for example, an CMOS type integrated circuit). (17) is a flip-flop which is connected at an input terminal D to the carry output $C_o$ of the adder-subtractor (16) and at an output terminal Q to the carry input terminal and in which the output of the adder-subtractor (16) is delayed one clock by the basic operation clock $\overline{CL128}$, and fed back to the carry input of (16). The output $S_o$ of the adder-subtractor (16) is coupled with the input IN of the shift register (18) of which the output OUT is coupled with the addition input A of the (16) through the gate (22) and (24). The adder-subtractpr (16), the shift register (18) and the flip-flop (17) constitute a 32-bit series additionsubtraction circuit.

Accordingly, for one up-pulse signal PUP generated when the car initiates its up-travelling, one pulse in synchronism with the timing signal TM13 is inputted to the addition-subtraction input B of the (16). At this time, the output of the gate (14) is at "1" level and thus the addition-subtraction selecting input M of the adder-subtractor (16) becomes "1" to permit the (16) to perform addition. Accordingly, a position pulse indicating a unit movement distance corresponding to one up-pulse from the position of the time slot 13 in the basic operation period toward the upper time slots is stored in the binary form.

At this time, if the contents of the shift register (18) is reset at the reference floor (for example, the lowermost floor), the shift register (18) produces from the OUT output a series car current position signal $S_I$ representing the distance from the reference floor of the car expressed by a series binary representation after the time slot 13 in the basic operation period of 32 bits.

When the car initiates its down travelling, the gate (13) produces pulses with the width equal to the basic operation period width in synchronism with the down-pulse PDN which passes through the gate (14) to enable the gate (15) to permit the timing signal TM13 to pass therethrough. During this time, the adder-subtractor selecting input M of the adder-subtractor (16) is made "0" level and the addition-subtraction input B is set as a subtraction input. Accordingly, the unit position pulse in synchronism with the timing pulse TM13 is loaded into the adder-subtractor (16). Therefore, the 32-bit series addition-subtraction circuit constituted by the (16), (17), and (18) operates as a subtractor. And upon receipt of one down-pulse signal PDN, the unit position signal in synchronism with the timing signal TM13 is subtracted and the car current position of the contents of the shift register (18) is decreased. The shift register (18) will be referred to as a current position register.

The floor position signal $\overline{Sx}$ is a series floor position signal represented in the binary form in which, in a floor position setting circuit (not shown), the distance from the pregiven reference floor is converted into the corresponding unit position pulses and it is of a series 32 bit construction and the position of the time slot 13 is so set as to correspond to one unit position pulse.

A switch (32) is used to set the floor position signal $\overline{Sx}$ in the current position register in order to set up the initial position. The output level of a gate (27) of a flip-flop comprised of gates (27) and (28) and connected to ordinary contacts *(32a)* and *(32b)* is at "0" level. Connection of the contact *(32a)* with the *(32b)* changes the output level of the gate (27) to be "1". Through cooperation of the flip-flop (29),(30) and an NAND gate (26), the NAND gate (26) produces at the output a pulse with the pulse width corresponding to one period of the timing signal TM00 when the output of the NAND gate (27) of the flip-flop rises. During one period of the basic operation period, this pulse disables the AND gate (22) while at the same time passes through an inverter (25) to enable the AND gate (23). Accordingly, the floor position signal $\overline{Sx}$ passes through the AND gate (24) to enter the addition input A of the subtractor (16). Consequently, the car position signal $S_I$ having thus far been stored in the current position register (18) is entirely replaced by the car position signal Sx.

To the current position register (18), non-power stoppage power source 5 VB to be described later has been supplied to the power source terminal Vcc. To the clock input terminal T, the basic clock signal $\overline{CL128}$ is inputted through an inverter (19) and a gate (20). The gate (20) is an NAND gate of open collector type and its output terminal is connected to the power source 5 VB, through a resistor (21). The input of the gate (20) is controlled by a clock control signal CCS.

Figure 3:
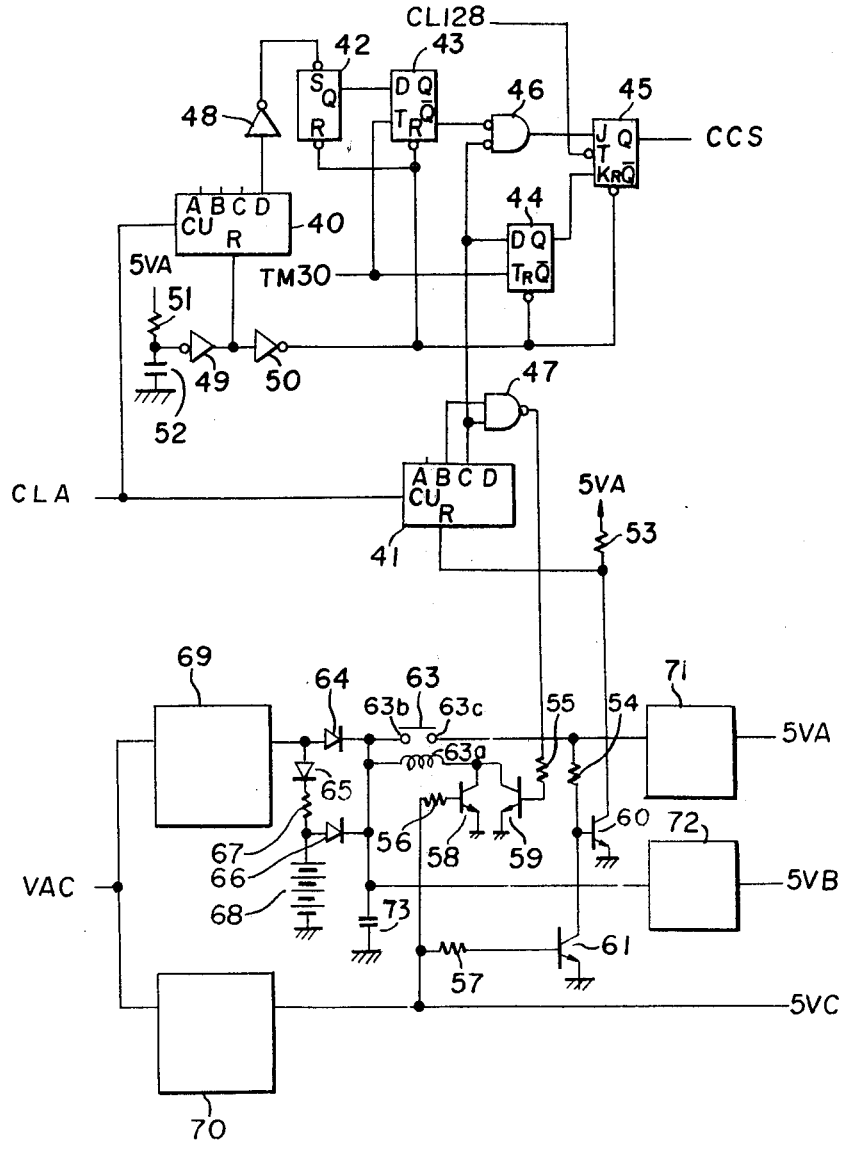
FIG. 3 shows a clock control signal generating circuit, a power source circuit and a power source control circuit of the embodiment.

FIG. 3 shows a clock control signal generator circuit, a power source circuit and a power source control circuit of an embodiment of the invention.

In the figure, (40) and (41) designate 4-bit binary counters each with a reset terminal R, four bits parallel outputs A, B, C and D and a count input terminal CU. (42) designates a flip-flop with set and reset terminals. (43) and (44) are flip-flops of edge trigger type. (45) is a J-K master slave flip-flop. (46) is a NOR gate. (47) is an NAND gate. (48), (49) and (50) are inverters. (51), (53) to (57) and (67) are resistors. (52) and (73) are capacitors. (58) to (61) are transistors. (63) is a relay. (63*a*) is its coil. (63*b*) and (63*c*) are contacts. (64) to (66) are diodes. (68) is a battery of 12 V. (69) is a DC power source of 15 V. (70) designates a constant voltage DC power source for forming a 5 V power source 5 VC for logical circuit supplied to the elevator control circuit (not shown). (71) is a voltage stabilizing circuit for outputting a 5 V power source 5 VA to be supplied to the clock control signal generating circuit and the power source control circuit in FIG. 3 and the current position detecting circuit in FIG. 2. (72) is a voltage stabilizer circuit for outputting a 5 V non-power stoppage power source supplied to the current position register in FIG. 2.

Generally, in the elevator control system, when it encounters power source trouble such as power stoppage, it is in emergency stop condition to stop the car immediately. However, a slight amount of time is elapsed till the car completely stops. Further, when the power source is restored to its normal condition, the elevator must operate normally. To this end, the final position at which the car completely stops is detected and stored.

In the present invention, an abnormal condition of the power source such the power stoppage of the power source 5 VC for the elevator control circuit is detected. The position detector is normally operated till the car completely stops and the current position of the car is statically stored in the current position register (18). To the end, the power source 5 VA comprised of the battery (68) and the voltage stabilizer circuit (71) and the non-power stoppage power source 5 VC comprised of the battery (68) for supplying current to the current position register even after the power source 5 VA is shut off and the voltage stabilizing circuit (72), are included. Even when the power source trouble occurs, the car position is correctly detected till the car completely stops. And after the stop of the car, the car position is statically stored in the current position register (18) till the power source is restored to a normal condition. After the power source is restored to its normal condition, the car immediately operates in a normal condition.

The detailed operation of the circuit shown in FIG. 3 will be described with reference to the timing charts of FIGS. 4 and 5.

In FIG. 3, the power source $V_{AC}$ is in a normal condition, the output of the constant voltage DC source (69) exhibits 15 V to charge the 12 V battery (68) through the diode (65) and the resistor (67) while at the same time to feed current through the diode (64) to the voltage stabilizing circuit (72) and to another voltage stabilizing circuit (71) through contacts (63*b*) and (63*c*) of the relay (63). In response to this, the voltage stabilizing circuits (71) and (72) output the power sources 5 VA and 5 VB stabilized of DC 5 V.

The constant voltage DC power source (70) produces the stabilized 5 VC of 5 V to be directed to the other elevator control circuit.

When the power source 5 VC is in a normal condition, base current of the transistor (58) flows through the resistor (56) to turn on the same transistor so that the coil (63*a*) of the relay (63) is energized to close contacts (63*b*) and (63*c*). Current flows into the base of the transistor (61), through the resistor (57), to turn on the same transistor, while at the same time to turn off the transistor (60). The collector of the transistor (60) is connected to the power source 5 VA via the resistor (53). For this, the reset terminal R of the binary counter (41) is at "1" level and it is in reset state and thus four bits outputs A, B, C and D are all at "0" level. Accordingly, the output of the NAND gate (47) is at 37 1" level to thereby turn on the transistor (59) through (55) of resistor. The capacitor (52) is charged through the resistor (51) to place the output of the inverter (49) to be at "0" level and the output of the inverter (50) to be "1". Therefore, the binary counter (40), the flip-flops (42), (43), (44) and (45) are not all in reset state. The clock signal CLA is clock signals generated by the oscillator circuit (not shown). The binary counter (40) is in counting condition to produce at the output pulse signals that the clock signal CLA is frequency-divided into 1/16. The pulse signal from the output terminal D passes through the inverter (48) to repeat setting of the flip-flop (42) so that the output of the flip-flop (42) is always kept at "1" level. Upon receipt of the Q output of the flip-flop (42), the $\overline{Q}$ of the flip-flop (43) also is "0". Since the C terminal of the binary counter (41) is "0", the Q output of the flip-flop (44) is "0" and the output of the NOR gate (46) is "1" and the J-K master slave flip-flop (45) is "1" at the Q output. The Q output of the (45) becomes the clock control signal CCS in FIG. 2.

Figure 4:
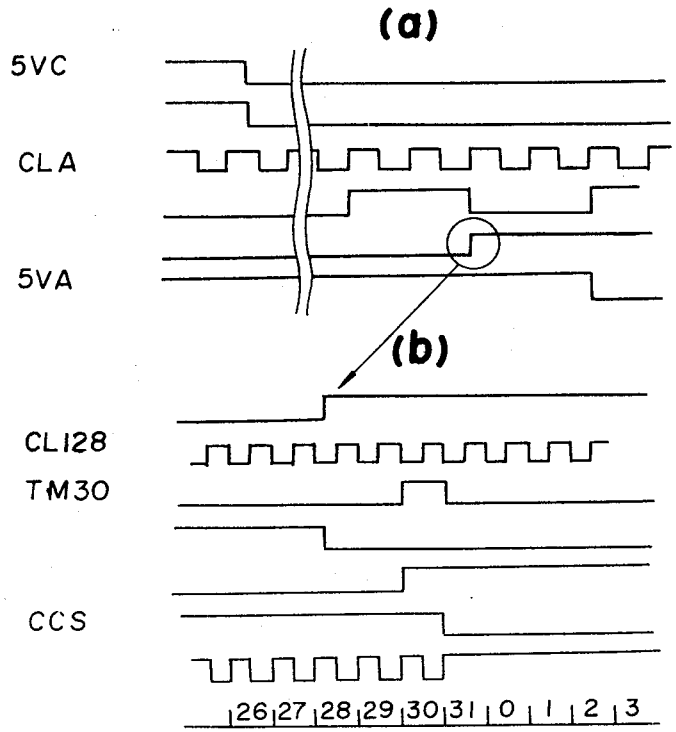
FIG. 4(*a*) shows a set of timing diagrams for illustrating the operations at the respective portions of the circuit when power stoppage occurs.

FIG. 4(*a*) shows a set of timing diagrams illustrating from the power stoppage to the power drop of the power source 5 VA. In the figure, (I) shows the collector terminal voltage of the transistor (60), (II) and (III) show the B terminal output and the C terminal output of the binary counter (41).

FIG. 4(*b*) shows timing diagrams enlarged in time scale of the rising portion of the (III). In the figure, (IV) is the J terminal input of the J-K master slave flip-flop (45), (V) is the K terminal input, and CCS is the clock control signal of the Q terminal output of the J-K master slave flip-flop (45). (VI) is the clock input of the current position register (18) shown in FIG. 2 and the output of the open collector gate (20).

When power stops, the power source 5 VC drops and the transistors (58) and (61) are turned off and the transistor (60) turned on. Accordingly, the collector output (I) thereof is "0" to release the reset of the binary counter (41), permitting it to initate its counting operation by the clock CLA.

At this time, the transistor (59) is turned on due to "1" level of the NAND gate (47) output so that the relay coil (63*a*) is continuously energized to keep the contacts (63*b*) and (63*c*) close. When the power stoppage causes the output voltage of the DC power source of (69) to drop, current from the battery (68) flows through the diode (66) to the voltage stabilizing circuits (71) and (72) so that the output of each of the voltage stabilizing circuits maintains the same voltage as before the stoppage. That is, the power sources 5 VA and 5 VB maintain their output voltages.

After the binary counter (41) initiates its counting operation by the clock CLA, the B terminal output of the binary counter (41) of (II) rises "1" at the third rises of the clock CLA counted from the power stoppage and the C terminal output of (III) rises "1" at the fifth rises. When the C terminal output is "1", the output (IV) of the NOR gate (46) becomes "0" and the timing signal TM30 triggers the flip-flop (44) to produce at the output (V) "1". Accordingly, the J-K master slave flip-flop (45) is conditioned so that its J input is "0" and its K inputs is "1", and the clock control signal CCS of the Q output is inverted from "1" to "0" at the fall of the basic operation clock CL128. This disables the gate (20) of the open collector type in FIG. 2 so that clock supply to the current position register (18) stops at the position of the time slot 30 of the basic operation period.

Figure 5:
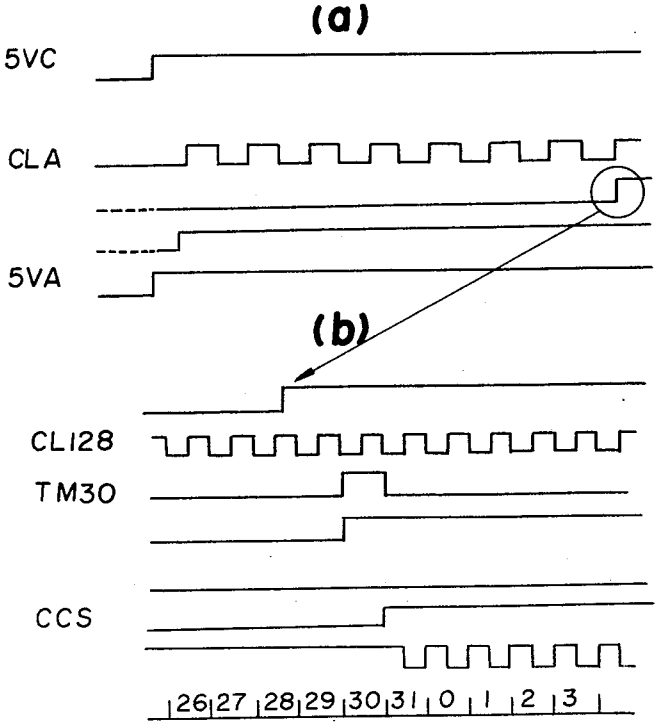
FIG. 5(*a*) shows timing diagrams for illustrating the operation at the respective portions when the power source restores from the power source trouble.

FIG. 5(*a*) shows timing diagrams illustrating the operation from the stage the power sources 5 VC and 5 VA restores from the stoppage of power to the stage that supply of clock to the current position register (18) restarts. In the figure, (VII) is the D terminal output of the binary counter (40), and (VIII) the output of the inverter (50) and when it is "0", it resets the respective flip-flops (43), (44) and (45).

FIG. 5(*b*) is timing charts enlarged in time scale of the rise portion of the (VII) in FIG. 5(*a*). In the Figure, (IV), (V) and (VI), as in FIG. 4(*b*), are the J terminal input and the K terminal input of the J-K master slave flip-flop (45) and the clock input signal of the current position register (18).

Referring again to FIG. 3, when the power source 5 VC restores from its trouble, the transistor (58) is turned on through the resistor (56) so that current flows from the battery (68) through the diode (66) to the coil (63*a*) of the relay. Thus, the contacts (63*b*) and (63*c*) of the relay are closed to permit current to flow to the voltage stabilizing circuit (71) and the power source 5 VA restores from its trouble. At the same time, the transistor (61) is turned on through the resistor (57) and the transistor (60) is turned off and the binary counter (41) is reset at the reset terminal to have "1" thereat. As a result, the output of the NAND gate (47) is "1" and the transistor (59) also is turned on through the resistor (55).

When the power source 5 VA becomes active, the capacitor (52) is charged through the resistor (51) and the output of the inverter (48) maintains "1" during the time period from the charge initiation of the capacitor till the potential of the capacitor exceeds the threshold potential of the inverter (49) input. The "1" level of the output of the inverter (49) initially resets the binary counter (40), and makes the output of the inverter (50) "0" with the result that the flip-flops (42), (43), (44) and (45) are initially reset.

When the potential of the capacitor exceeds the input threshold potential of the inverter (49), its output is inverted "0" and the resetting of the binary counter (40) is released to permit it to initiate its counting operation by the clock CLA. After the resetting is released, i.e. the (VIII) rises, at the eighth rises of the clock CLA, the D output of the binary counter (40) rises "1" which in turn passes through the inverter (48) to set the flip-flop (42) to have "1" at the Q output. The "1" Q output is applied to the flip-flop (43) which in turn is edge-triggered by the timing signal TM30 to produce "0" at the $\overline{Q}$ output (43) and the output of the NOR gate (46), i.e. the J terminal input (IV) of the J-K master slave flip-flop (45), becomes "1". At this time, the Q output of the flip-flop (44), i.e. the K terminal input, remains "0" since the binary counter (41) is in reset state. Accordingly, the Q output of the (45), i.e. the clock control signal CCS, is inverted to "1" level at the fall of the basic operation clock CL128. This enables the open collector gate (20) in FIG. 2 of which the output signal (VI) initiates the supply of clock to the current position register (18).

In this manner, the supply of clock to the current position register (18) is stopped at the time slot 30 of the basic operation period. And after the power stoppage ceases, it is initiated at the time slot 31. Therefore, the contents of the current position register is absolutely the same as of it before power stoppage.

After restoration from the abnormal condition of power source such as power stoppage, the position detecting circuit is initially reset and after the circuit restores to its normal condition, clock is supplied to the current position register (18) so that it shifts correctly to its automatic storing operation of the car position. The binary counter (40) is used to produce a time delay signal to effect such the operation. The binary counter (41) has two functions; one is to maintain the power source 5 VA to provide a correct operation of the position detecting circuit during the time period from initiation of the power trouble such as power failure to complete stoppage of the car; the other is to determine the time to stop the clock to be supplied to the current position register (18). It will be understood that the frequency of the clock CLA and number of stages of the binary counter (41) are changeable if necessary.

As described above, a shift register with high density of integration and low power consumption of CMOS or the like is used. In a ordinary condition, the car position of elevator is dynamically loaded into the shift resister. In power trouble such as power failure or restoration from such, the clock supply to the shift register is controlled. In the power stoppage, the non-power stoppage power source 5 BV with extremely small capacity supplies power only to the shift register to statically load the car position information thereinto. As a matter of course, the car position information may be loaded into the counter IC with high integration density and low power consumption. The use of the counter IC is advantageous in that control by supplied clock is unnecessary. However, it is inferior to the shift register in the memory capacity per package. Therefore, the use of the counter IC is accompanied by increase of package number and thus need of large capacity of the non-power stoppage power source.

What is claimed is:

1. In an elevator system to be controlled by a car position signal obtained by detecting relatively an amount of travel of an elevator car by means of a digital position detecting means, an elevator control system comprising; a first power source means; a detecting means for detecting ceasing of said first power source means function due to power stoppage or other power trouble; a car position detecting means including a position signal storing circuit for electrically storing said car position signal representing the car position; second power source means for supplying power source to said car position detecting means to secure its normal operation till the car completely stops after said power stoppage or power trouble; third power source means for supplying power source to only said position signal storing circuit included in said car position detecting means after said second power source means ceases its function; whereby the final position at which the car stops due to its stoppage of power or other power trouble is continuously stored with an accuracy and, after restoration of the power source from the power stoppage or other power troubles, the car may quickly initiate its normal operation.

2. An elevator control system according to claim 1, in which said car position detecting means includes a shift register for storing said car position signal in the form of a cyclic series binary signal, a non-power stoppage power source for supplying power source only to said shift register and a clock control circuit for control the clock supplied to said shift register when power troubles such as power stoppage is detected or the power source is restored from the power trouble, wherein, in normal condition, the car position signal is dynamically loaded into said shift register and, in the power trouble, it is statically loaded into said shift register.

3. An elevator control system according to claim 1, in which said car position detecting means comprises a pulse generator for detecting the travelling direction of the car and for generating a pulse train proportional to the travelling amount, an adder-subtractor circuit, a shift register circuit, a clock generating circuit for generating a clock pulse signal to drive said shift register, a timing pulse generating circuit of which the pulse width is equal to the period of said clock pulse signal and the frequency equals the quotient of the frequency of said clock pulse signal and number of bits of said shift register circuit, and a synchronizing circuit for synchronizing the output pulse of said pulse generating circuit with said timing pulse signal, whereby the car position signal expressed in a cyclic series binary form is obtained for the output of said shift register circuit.

4. An elevator control system according to claim 3, further comprising; a second car position signal generating means for generating a car position signal for any of the floors having the same construction as of said car position signal expresses in the cyclic series binary form outputted from said shift register circuit; and signal selecting means which is positioned between said shift register circuit and said adder-subtractor circuit to select the output of said shift register or the output of said adder-subtractor circuit, and the output of said second car position signal generating means which in turn is applied to said adder-subtractor circuit or said shift register circuit.

* * * * *